United States Patent [19]

Takanashi et al.

[11] 4,338,542

[45] Jul. 6, 1982

[54] DIRECTLY HEATED CATHODE ASSEMBLY

[75] Inventors: Yukio Takanashi, Hiratsuka; Shouji Nakayama, Yokosuka; Toshiharu Higuchi, Yokohama, all of Japan

[73] Assignee: Tokyo Shibaura Denki Kabushiki Kaisha, Kawasaki, Japan

[21] Appl. No.: 115,384

[22] Filed: Jan. 25, 1980

[30] Foreign Application Priority Data

Jan. 31, 1979 [JP] Japan ..... 54-9137

[51] Int. Cl.[3] ..... H01J 29/04

[52] U.S. Cl. ..... 313/446; 313/146; 313/341; 313/459

[58] Field of Search ..... 313/459, 37, 446, 417, 313/270, 341, 146, 147

[56] References Cited

U.S. PATENT DOCUMENTS

| | | | |
|---|---|---|---|
| 3,213,318 | 10/1965 | Glenn, Jr. | 313/147 X |
| 3,441,767 | 4/1969 | Kerstetter | 313/37 |
| 3,444,416 | 3/1969 | Yoshida et al. | 313/446 |
| 3,541,382 | 11/1970 | Takanashi et al. | 313/270 X |
| 4,076,995 | 2/1978 | Kolbeck et al. | 313/446 |
| 4,259,610 | 3/1981 | Takanashi et al. | 313/459 |

FOREIGN PATENT DOCUMENTS

| | | | |
|---|---|---|---|
| 988143 | 4/1976 | Canada | 313/37 |

*Primary Examiner*—Palmer C. Demeo

*Attorney, Agent, or Firm*—Cushman, Darby & Cushman

[57] ABSTRACT

Disclosed is a directly heated cathode assembly for a cathode ray tube electron gun, comprising first and second conductive support members disposed to face each other via an insulating base plate, a ribbon filament stretched between the first and second conductive support members such that the width direction thereof is parallel with the axis of the electron gun, a cathode consisting of a metal substrate covered with an electron emissive coating and a support portion integral with or fixed to the metal substrate, the coating layer extending in a direction perpendicular to the axis of the electron gun and the cathode being mounted to the central portion of the filament, and at least one spring member whose free end resiliently abuts against the filament in a direction perpendicular to a plane including the axis of the electron gun.

12 Claims, 28 Drawing Figures

DIRECTLY HEATED CATHODE ASSEMBLY

This invention relates to a cathode ray tube, particularly, to a directly heated cathode assembly suitable for use in in-line type electron guns for a color picture tube.

An in-line type electron gun incorporated into a color picture tube comprises a directly heated composite cathode assembly as shown in FIG. 1, first to fourth grid electrodes, etc. The conventional directly heated cathode assembly shown in FIG. 1 comprises an insulating base plate 1 formed of ceramics or the like. It is seen that the plate 1 is provided with three through-holes 4 and three cutouts 5. Three pairs of first and second conductive support members 2, 3 are inserted into these through-holes 4 and cutouts 5. Step portions (not shown) for housing a bonding material used for fixing the first and second conductive support members 2, 3 to the insulating base plate 1 are formed at the edge portions of the through-holes 4 and cutouts 5. Grooves 6, 7 of a predetermined depth are formed in the surface region of the base plate 1 so as to provide three cathode regions separate from each other.

The first conductive support member 2 serves to support one end of a ribbon-shaped filament 10 and the second conductive support member 3 serves to support the other end portion of the filament 10. As shown in the drawing, a metal substrate 8 covered with an electron emissive coating 9 is mounted to the central portion of the filament 10. A spring member 11 having the lower end fixed to the second support member 3 is provided such that the other end of the filament 10 extending beyond the second support member 3 is supported by the upper end of the spring member 11. It follows that the thermal expansion of the filament 10 is absorbed by the spring member 11. The second support member 3 is in the form of a hollow rod with a rectangular cross section and acts as a guide of a movable adjusting rod 12 serving to maintain a predetermined distance between the electron emissive coating 9 and a first grid (not shown). The upper end of the rod 12 abuts against the filament 10 so as to adjust the height of the coating 9.

The first conductive support member 2 is bonded to the insulating base plate, after being inserted through the through-hole 4. Likewise, the second conductive support member 3 is bonded to the plate, after being engaged with the cutout 5. As described previously, the spring member 11 serves to absorb the thermal expansion of the filament 10 when the filament 10 has been heated. Further, the spring member performs a cushioning function when the filament 10 has been moved up and down.

The electron emissive coating 9 is prepared by coating the upper surface of the metal substrate 8 consisting of a Ni-based alloy containing Mg, Si, W, etc. with a carbonate of Ba, Sr or Ca, followed by activating the carbonate coating so as to convert the carbonate into an oxide. The resultant oxide coating emits thermoelectrons. The movable adjusting rod 12 is mounted to the cathode assembly after a plurality of grids and the insulating base plate 1 have been erected on, for example, a bead glass and assembled into an integral body. Specifically, the rod 12 is inserted into the second support member 3 after the assemblage and moved up and down within the second support member so as to adjust the height of the electron emissive coating 9. Finally, the rod 12 is fixed to the second support member 3 by, for example, welding.

In the conventional directly heated cathode assembly shown in FIG. 1, three cathodes are assembled on a single insulating base plate as described above. This renders it troublesome to adjust the distance between the electron emissive coatings 9 and the apertures of a first grid disposed above the filaments 10 in producing the cathode assembly. Further, if one of the three cathodes is defective, the entire cathode assembly must be discarded, leading to a high manufacturing cost of the assembly. It should also be noted that even the shape of the insulating base plate must be changed where it is necessary to produce cathode assemblies with differing distances between the three beam-passing apertures depending on the kind of the cathode ray tube or electron gun.

An additional difficulty inherent in the conventional assembly shown in FIG. 1 is that the ribbon-shaped filament 10 is disposed such that the width direction thereof is parallel with the upper surface of the base plate 1. In other words, the surface of the filament 10 is parallel with the upper surface of the insulating base plate 1. Therefore, the central portion of the filament is displaced in the axial direction of the assembly when the filament has been deformed by thermal expansion, resulting in a change in the distance between the first grid and the electron emissive coating 9. The change mentioned brings about a change in the cut-off voltage, leading to, for example an erroneous white balance adjustment of a color picture tube.

The conventional assembly shown in FIG. 1 is also defective in that a filament current flows through the spring member 11. Thus, heat is generated within the spring member 11, thereby weakening the resilience of the spring member. As a result, a change is brought about in the distance between the electron emissive coating 9 and the first grid. In general, a material having a very high resistance such as Inconel X (trade name) is used for forming the spring member 11. The change in distance mentioned above is particularly serious where the spring member is formed of a high resistance material. Further, the variation in the resistance of the spring member 11 is directly proportional to the variation in current flowing through the filament. Thus, it is necessary to make the spring member 11 as small in the resistance variation as possible.

An object of this invention is to provide a directly heated cathode assembly capable of maintaining constant the distance between the electron emissive coating and the first grid and preventing electric current from flowing through a spring member. Naturally, the spring member is not heated because electric current does not flow therethrough. When incorporated into a unitized structure of electron guns for a color cathode ray tube the dimension of each cathode assembly can be adjusted independently.

According to this invention, there is provided a directly heated cathode assembly for a cathode ray tube electron gun, comprising first and second conductive support members disposed to face each other via an insulating base plate, a ribbon filament stretched between the first and second conductive support members such that the width direction thereof is parallel with the axis of the electron gun, a cathode consisting of a metal substrate covered with an electron emissive coating and a support portion integral with or fixed to the metal substrate, the coating layer extending in a direction perpendicular to the axis of the electron gun and the cathode being mounted to the central portion of the filament, and at least one spring member whose free end resiliently abuts against the filament in a direction perpendicular to a plane including the axis of the electron gun.

This invention can be more fully understood from the following detailed description when taken in conjunction with the accompanying drawings, in which.

Figure 1:
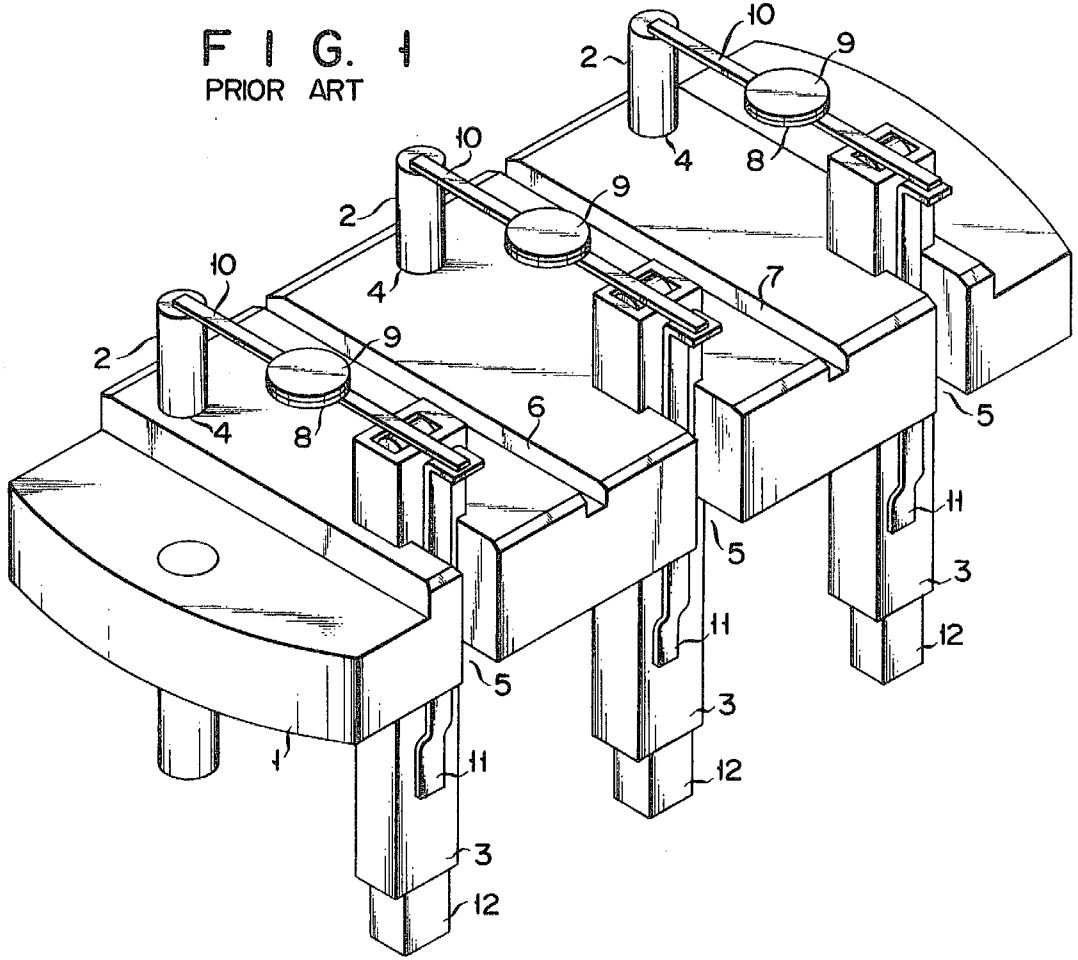
FIG. 1 PRIOR ART
FIG. 1 is an oblique view showing a conventional directly heated cathode assembly.
Figure 2:
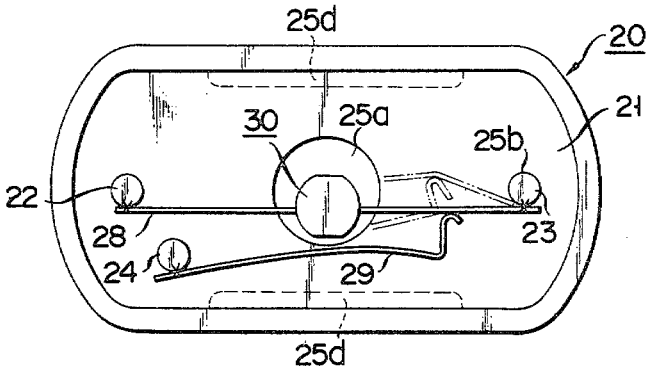
FIG. 2 is a plan view showing a directly heated cathode assembly according to one embodment of this invention.
Figure 3:
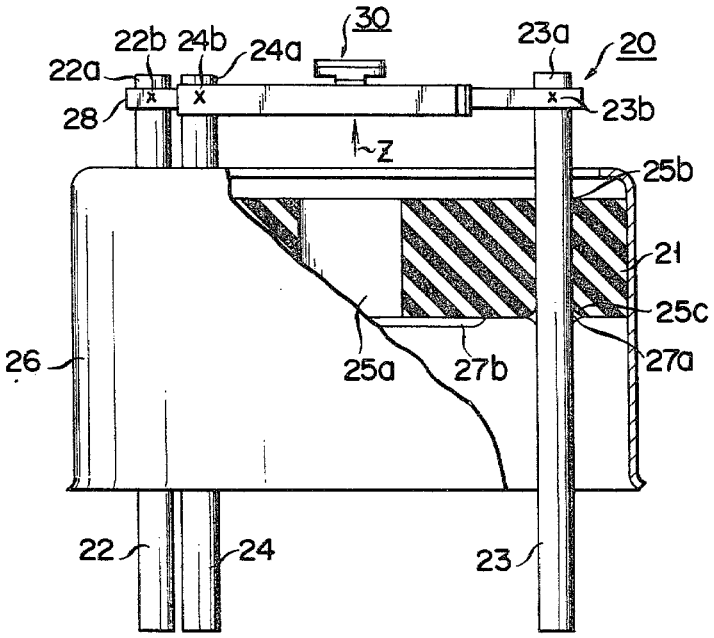
FIG. 3 is a cross sectional view, partly broken away, of the assembly shown in FIG. 2.
Figure 17:
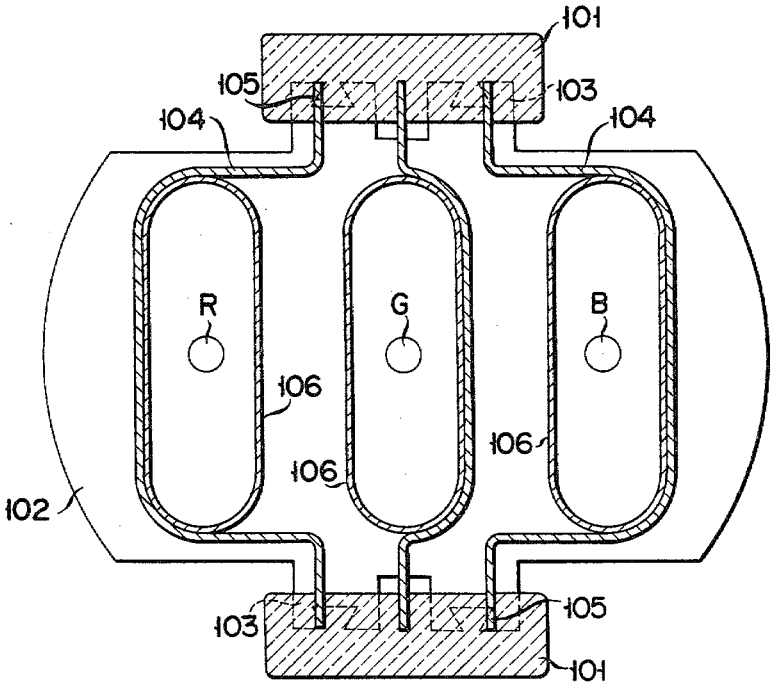
Figure 18:
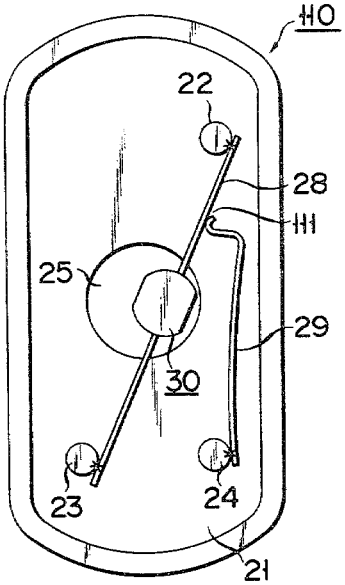

FIGS. 4 to 6B collectively show how to mount a cathode to a filament in an assembly of this invention;

FIGS. 7 to 16 show modifications of construction for mounting a cathode to a filament;

FIG. 17 shows how three directly heated cathode assemblies shown in FIGS. 2 and 3 are incorporated into a unitized structure of in-line type electron guns; and FIGS. 18 to 25 are plan views each showing a directly heated cathode assembly according to another embodiment of this invention.

FIGS. 2 and 3 collectively show a directly heated cathode assembly according to one embodiment of this invention. It is seen that a first conductive support member 22, a second conductive support member 23 and a spring support member 24 are erected through an insulating base plate 21 formed of, for example, ceramics. The base plate 21 is provided at the central portion with on aperture 25*a* whose center is positioned on an axis "Z" of the electron gun. FIG. 3 shows a through-hole 25*b* through which is inserted the second conductive support member 23. The lower edge of the through-hole 25*b* is countersunk so as to provide a recess 25*c* housing a bonding material 27*a* such as bonding glass or soldering material serving to fix the second conductive support member 23 to the base plate 21. The wall defining the recess 25*c* is, for example, metallized. The base plate 21 is also provided with through-holes through which are inserted the first conductive support member 22 and the spring support member 24, though the through-holes mentioned are not shown in the drawings. Naturally, recesses housing a bonding material are formed at the lower edges of these through-holes for fixing the support members 22, 24 to the base plate. The insulating base plate 21 itself is also provided at the lower edge portion with a recess 25*d* for housing a bonding material 27*b*. After inserted into a cathode cylinder 26, the base plate 21 is fixed to the cylinder 26 by the bonding material 27*b* housed in the recess 25*d*.

A ribbon filament 28 is stretched between the first and second conductive support members 22 and 23. Specifically, the filament 28 is fixed to the support members 22, 23 at welding points 22*b*, 23*b* provided at side portions 22*a*, 23*a* near the heads of the support members 22, 23. The filament 28 is formed of an alloy consisting of Ni(70 wt%) and W(30 wt%) has, in general, a width of 0.2 to 0.5 mm and a thickness of 0.02 to 0.04 mm, and is mounted such that the width direction thereof is substantially parallel with an axial direction Z of the electron gun. One end of a spring member 29 is fixed to the spring support member 24 at a welding point 24*b* provided at a side portion 24*a* near the head of the support member 24. The spring member 29 serves to push the filament 28 in a direction perpendicular to a plane including the axis of the electron gun. A cathode 30 is mounted to the central portion of the ribbon filament 28 such that the faces of the cathode are parallel with the upper face of the insulating base plate 21.

Figure 4:
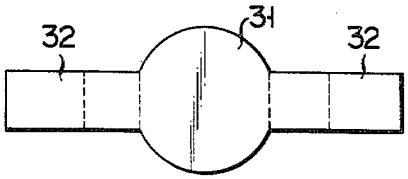
Figure 5A:
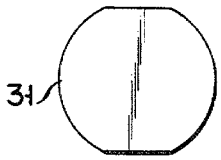
Figure 5B:
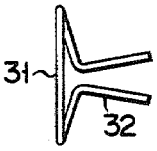
Figure 5C:
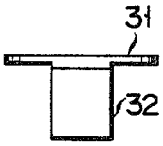
Figure 6A:
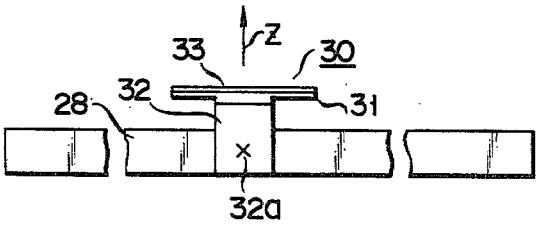
Figure 6B:
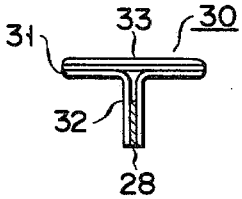
Figure 7:
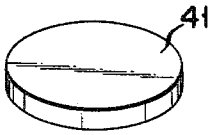

FIGS. 4 to 6B collectively show how to mount a cathode to a filament. Specifically, a Ni-based metal substrate consisting of a substantially circular main surface portion 31 and support portions 32 as shown in FIG. 4 is folded as shown in FIGS. 5A, 5B and 5C. The filament 28 is held between the support portions 32 of the cathode 30, followed by welding at a welding point 32*a*. Then, the upper face of the main surface portion 31 is coated with a carbonate of Ba, Sr or Ca. The carbonate coating is activated later for conversion into an oxide coating so as to provide an electron emissive coating 33. In the cathode 30 described above, the main surface portion 31 is not provided with a welding point. It follows that the main surface portion 31 is free from bending.

It is desired to make the support portion 32 of cathode 30 as narrow as possible so as to decrease the thermal capacity of the cathode 30, as far as the filament 28 can be held firmly. If the cathode 30 has a small thermal capacity, the cathode ray tube is enabled to display a picture image promptly.

Figure 8:
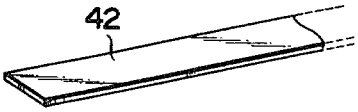
Figure 9:
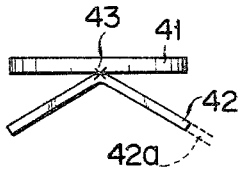
Figure 10:
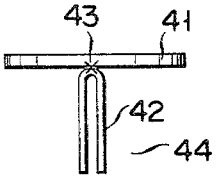
Figure 11:
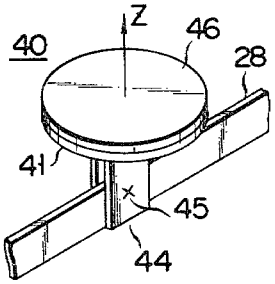

FIGS. 7 to 11 collectively show another fashion of mounting a cathode 40 to a filament. In this embodiment, a Ni-based metal strip 42 shown in FIG. 8 is folded about the center thereof as shown in FIG. 9. On the other hand, a Ni-based circular metal substrate 41 shown in FIG. 7, which is prepared by, for example, punching, is welded at a welding point 43 to the folded portion of the metal strip 42. Naturally, the welding point 43 is located about the center of the metal substrate 41. After the welding undesired portion 42*a* of the metal strip 42 is cut away. Then, the metal strip is formed into U-shape as shown in FIG. 10 for holding the filament 28, followed by welding the metal strip to the filament at a welding point 45 as shown in FIG. 11. Finally, an electron emissive coating is formed on the upper face of the metal substrate 41 as described previously. The method of FIGS. 7 to 11 is simpled than that of FIGS. 4 to 6B and permits the cathode 40 to bear a small thermal capacity.

Figure 12:
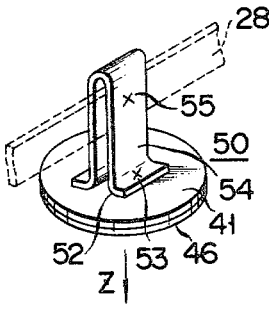

FIGS. 12 to 16 show modified methods of mounting a cathode to a filament. In FIG. 12, a cathode 50 comprises a U-shaped metal strip 54 and the metal substrate 41. The metal substrate 41 is welded at a welding point 53 to a flange 52 formed at the end portion of the metal strip 54. Further, the filament 28 is held about the folded portion of the U-shaped metal strip 54 and welded at a welding point 55 to the metal strip 54. The embodiment of FIG. 12 facilitates determining the desired location of the metal substrate.

Figure 13:
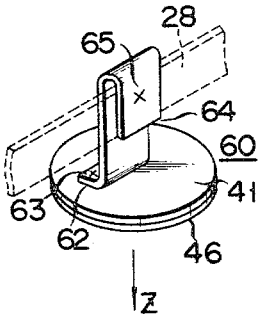

A cathode 60 shown in FIG. 13 is substantially equal to the cathode 50 shown in FIG. 12 except that a metal strip 64 shown in FIG. 13 has only one flange unlike the metal strip 54 which has two flanges 52 as shown in FIG. 12. In the embodiment of FIG. 13, one end portion 62 of the metal strip 64 is bent in an L-shape and welded at a welding point 63 to the metal substrate 41. On the other hand, the other end portion of the metal strip 64 is folded into U-shape for holding the filament 28 and welded at a welding point 65 to the filament 28. Naturally, the cathode 60 of FIG. 13 bears a smaller thermal capacity than the cathode 50 of FIG. 12.

Figure 14:
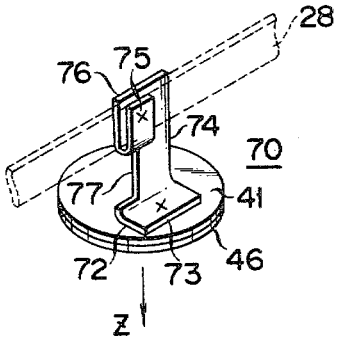

In a cathode 70 of FIG. 14, one end portion 72 of a metal strip 74 is bent in an L-shape and welded at a welding point 73 to the metal substrate 41. Further, the central portion of the metal strip 74 is partly cut such that the cut portion can be folded toward to other end 76 of the metal strip. As shown in the drawing, the filament 28 is held at the folded portion of the metal strip 74 and the metal strip is welded at a welding point 75 to the filament 28. The cathode 70 shown in FIG. 14 bears a further smaller thermal capacity.

Figure 15:
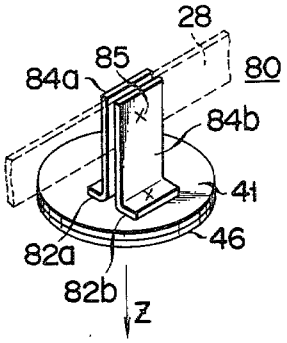

In a cathode 80 shown in FIG. 15, a pair of metal strips 84*a*, 84*b* are disposed in parallel. The metal strips 84*a*, 84*b* are bent in an L-shape at end portions 82*a*, 82*b*, respectively, and welded to the metal substrate 41 at the end portions 82*a*, 82*b*. In this embodiment, the filament 28 is held between the metal strips 84*a*, 84*b* at the other end portions and welded at a welding point 85 to the metal strips. The construction of FIG. 15 permits somewhat simplifying the manufacturing process of the cathode because it is unnecessary to fold a metal strip into U-shape.

Figure 16:
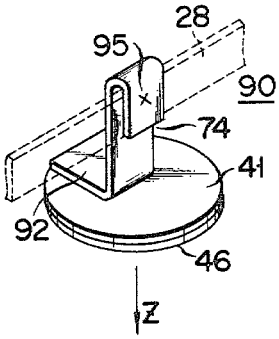

In a cathode 90 shown in FIG. 16, a metal strip 92 is integral with the circular metal substrate 41. It is seen that the metal strip 92 is folded toward the center of the substrate 41 at the periphery of the substrate and bent at right angles at the central portion of the substrate 41. Further, the tip portion of the metal strip 92 is folded again into U-shape and welded at a welding point 95 to the filament 28 as in the cathode 60 shown in FIG. 13. In the embodiment of FIG. 16, welding is applied to one portion alone. In addition, the embodiment of FIG. 16 permits readily determining the desired location of the metal substrate 41. Incidentally, the arrow "Z" shown in FIGS. 12 to 16 represents the direction in which an electron beam is emitted from the cathode, i.e., the axis of the electron gun.

In the embodiments described above, the filament is supported from both sides by the metal strip. Thus, the thermal strain of the metal strip caused by the heating of the filament is uniform on both sides of the filament. Further, the filament does not bear a welding damage caused by the current flowing through the filament in the welding step.

FIG. 3 shows that the filament 28 extends somewhat beyond the first and second conductive support members 22 and 23. This is because the end portions of the filament are held outside the support members 22 and 23 in the welding step so as to pull somewhat the filament.

FIG. 2 shows that the filament 28 is stretched between the support members 22, 23 such that the center of the cathode 30 deviates from the center of the aperture 25*a*. However, the cathode 30 is moved to the center of the aperture 25*a*, when heated. Specifically, the filament 28 is thermally expanded during operation of the electron gun and, thus, moved to the position shown by broken lines by the bias force of the spring member 29. It follows that the cathode 30 is moved to the center of the aperture 25*a*, namely, the center of the cathode 30 is positioned on the axis "Z" of the electron gun.

FIG. 17 shows how the cathode assembly 20 shown in FIGS. 2 and 3 is mounted to a unitized electron gun of in-line type for, for example, a color television. As shown in the drawing, a first grid 102 provided with electron beam-passing holes R, G, B arranged in a row is supported at the end portions 103 between a pair of insulating support bars 101 formed of, for example, bead glass. Of course, the other grids (not shown) are also supported between the bars 101. Further, plate like cathode supporting belts 104 serving to support cathode supporting cylinders 106 are supported at the end portions 105 between the insulating support bars 101. As described previously, the directly heated cathode assembly 20 shown in FIGS. 2 and 3 is inserted into the cylinder 106. Under this condition, the distance between the holes R, G, B of the first grid 102 and the electron emissive coatings 33 of the cathodes 30 facing the holes R, G, B is measured by, for example, an air micrometer as in the conventional heater type cathode assembly. It should be noted that the filament 28 is provided such that the width direction thereof is parallel with the axis "Z" of the electron gun. Therefore, the filament 28 exhibits such a high mechanical strength in the axial direction of the electron gun that the filament 28 is scarcely displaced in the axial direction by the air pressure of the air micrometer. It follows that the distance measured by the air micrometer very accurately reflects the actual distance under the normal condition. Finally, three cathode cylinders 26 each housing the cathode assembly 20 are fixed by, for example, welding to the cathode supporting cylinders 106 so as to produce a unitized structure of in-line type three electron guns.

The directly heated cathode assembly of this invention described above is advantageous over the conventional cathode assembly in various points as described in the following. First of all, the filament 28 is provided in this invention such that the width direction thereof is parallel with the axial direction of the electron gun. In addition, the bias force of the spring member 29 is exerted to the filament 28 in a direction perpendicular to the axial direction of the electron gun. It follows that, when the filament 28 has been thermally expanded during operation of the electron gun, the cathode is moved in a direction perpendicular to the axial direction of the electron gun, resulting in that the axial distance between the first grid and the electron emissive coating is maintained constant. Accordingly, an error is unlikely to take place when the electron gun is turned on and off repeatedly in the white balance adjustment of a color picture tube.

Further, filament current does not flow through the spring member 29 in this invention. Naturally, the spring member 29 is not heated and, thus, the bias force thereof is not reduced. In addition, variation of filament current is reduced.

An additional merit to be noted is that each cathode assembly can be handled independly like a heater type cathode assembly in preparing a unit of three electron guns for use in a color picture tube. To be more specific, the cathode assembly itself need not be redesigned even when used for preparing units of three electron guns differing from each other in the distance between the cathodes. Further, it suffices to discard a defective cathode assembly alone, if any.

FIGS. 18 to 25 show various fashions of the locational relationship between the filament 28 and the spring member 29. In a cathode assembly 110 shown in FIG. 18, the first and second conductive support members 22 and 23 are provided on a diagonal of the insulating base plate 21. This arrangement is effective for reducing the size of the cathode assembly. Further, a resilient contact point 111 between the filament 28 and the spring member 29 is greatly shifted in accordance with thermal expansion of the filament 28.

Figure 19:
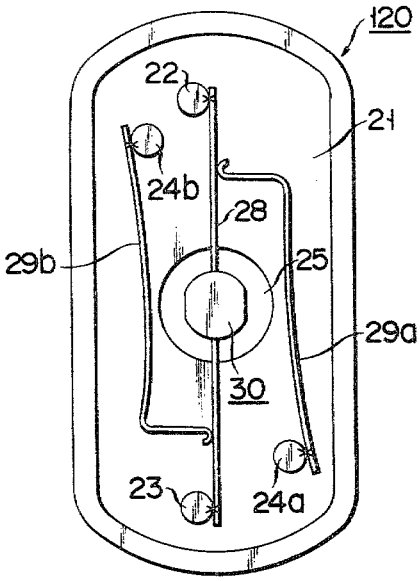

In a cathode assembly 120 shown in FIG. 19, the filament 28 is stretched in the longitudinal direction of the base plate 21. In this embodiment, the cathode 30 is originally positioned in the center of the aperture 25. Further, first and second spring member 29*a* and 29*b* having the base portions fixed to first and second spring support members 24*a* and 24*b*, respectively, are allowed to abut against the filament 28 in opposite directions at symmetrical points with respect to the center of the cathode 30. This embodiment is advantageous in that the cathode 30 is always positioned in the center of the aperture 25, leading to a high accuracy in the positioning of the cathode 30.

Figure 20:
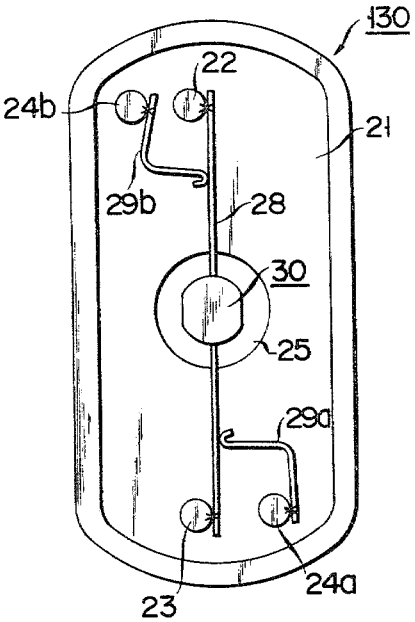

A cathode assembly 130 shown in FIG. 20 is equal to the cathode assembly 120 shown in FIG. 19 except that the first and second spring members 29*a*, 29*b* used in the assembly 130 are shorter than those used in the assembly 120. Naturally, the embodiment of FIG. 20 permits saving the material cost.

Figure 21:
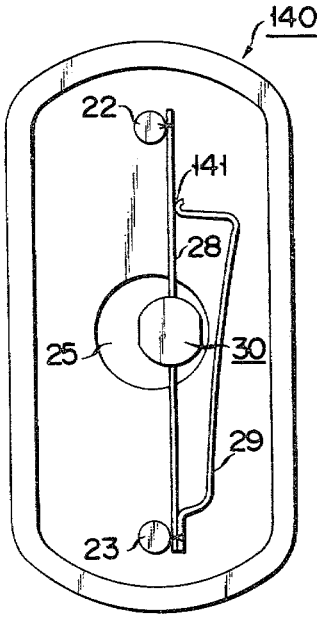

In a cathode assembly 140 shown in FIG. 21 a spring support member is not provided and the base of the spring member 29 is fixed to the second conductive support member 23. In this embodiment, it is necessary to provide the spring member 29 with an insulation member such as a metal oxide film at the free end portion which resiliently abuts against the filament so as to prevent electric current from flowing through the spring member 29. The embodiment of FIG. 21 permits simplifying the manufacturing process and saving the material cost.

Figure 22:
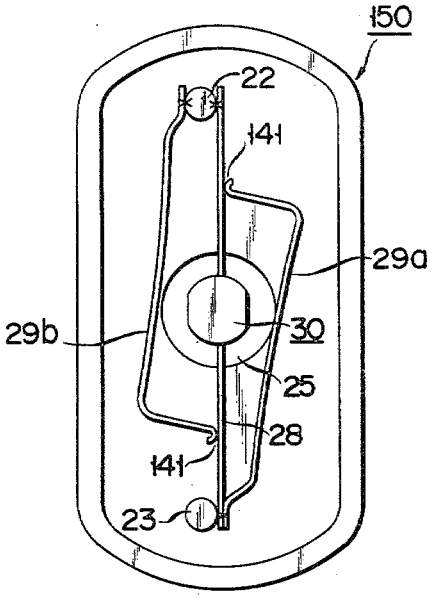
Figure 23:
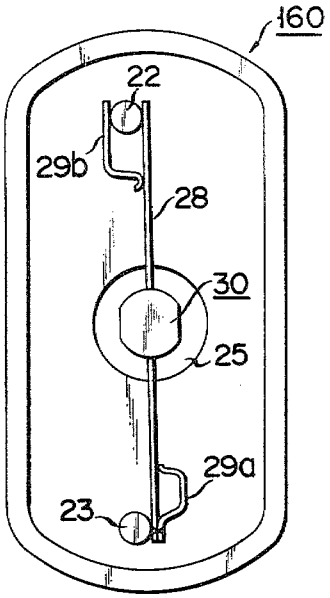

A cathode assembly 150 shown in FIG. 22 is substantially equal in construction and effect the combination of the cathode assemblies 90 and 140 shown in FIGS. 19 and 21, respectively. Likewise, a cathode assembly 160 shown in FIG. 23 is substantially equal in construction and effect to the combination of the cathode assemblies 130 and 140 shown in FIGS. 20 and 21, respectively.

Figure 24:
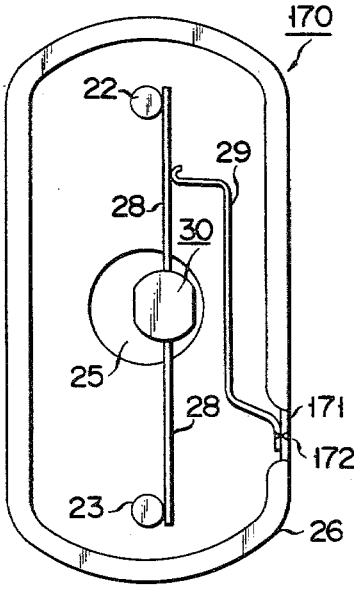

In a cathode assembly 170 shown in FIG. 24, one end 171 of the spring member 29 is welded at a welding point 172 to an extended portion of the cathode cylinder 26. In general, modulation signals are applied to the cathode 30 in a cathode drive type electron gun. The particular fashion of mounting the spring member shown in FIG. 24 permits stabilizing the cathode cylinder potential. Further, the embodiment of FIG. 24 renders it unnecessary to provide a spring support member, leading to a low manufacturing cost of the cathode assembly.

Figure 25:
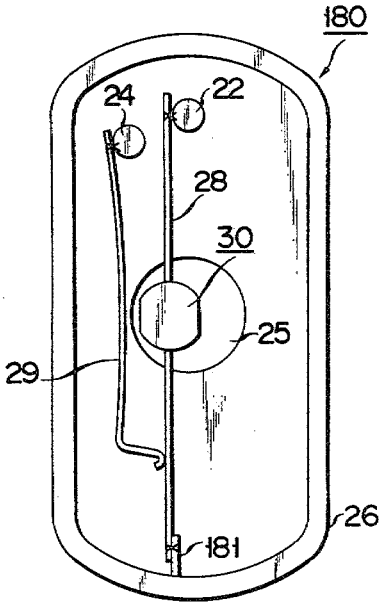

In a cathode assembly 180 shown in FIG. 25, a second conductive support member 181 is mounted to an extended portion of the cathode cylinder 26 or directly to the cathode cylinder 26 in order to further decrease the electric resistance. It is preferred in this embodiment that the support member 181 be relatively thick and be welded to the cathode cylinder.

This invention is not restricted to the embodiments shown in the accompanying drawings. It is possible to provide various modifications of directly heated cathode assembly within the scope of technical idea of this invention.

What we claim is:

1. A directly heated cathode assembly for a cathode ray tube electron gun having an axis along which electrons are directed, comprising:

an insulating base plate;

first and second conductive support members attached to the insulating base plate;

a ribbon filament stretched lengthwise between the first and second conductive support members and oriented such that its width direction is parallel with the axis of the electron gun;

a cathode comprising a metal substrate covered with an electron emissive coating and a support portion integral with or fixed to the metal substrate, the coating layer being in a plane perpendicular to the axis of the electron gun and the cathode being mounted to a central portion of the filament via its support portion;

a spring support member attached to the insulating base plate; and a spring member having a first free end resiliently abutting against the filament in a direction perpendicular to a plane including the axis of the electron gun and having a second end attached to the spring support member.

2. An assembly according to claim 1, further including an additional spring support member and an additional spring member, the free ends of the spring members abutting the filament at respectively two symmetrical points with respect to the center of the cathode.

3. A directly heated cathode assembly for a cathode ray tube electron gun having an axis along which electrons are directed, comprising:

an insulating base plate;

first and second conductive support members attached to the insulating base plate;

a ribbon filament stretched lengthwise between the first and second conductive support members and oriented such that its width direction thereof is parallel with the axis of the electron gun;

a cathode comprising a metal substrate covered with an electron emissive coating and a support portion integral with or fixed to the metal substrate, the coating layer being in a plane perpendicular to the axis of the electron gun and the cathode being mounted to a central portion of the filament via its support portion; and a spring member having a first end fixed to one of the first and second conductive support members, an insulating layer being formed on a second free end thereof which resiliently abuts against the filament in a direction perpendicular to a plane including the axis of the electron gun.

4. An assembly according to claim 3, further including an additional spring member, the respective second free ends of the two spring members resiliently abutting against the filament at respectively two symmetrical points with respect to the center of the cathode, the first ends thereof being fixed respectively to the first and second conductive support members an insulating layer being formed on free end portions of each of the two spring members.

5. An assembly according to claim 4, wherein the first and second conductive support members are erected through an insulating base plate.

6. The assembly according to claim 1 or 3, wherein the support portion of the cathode is provided by two extended portions integral with the metal substrate and folded in a manner to hold the filament therebetween.

7. The assembly according to claim 1 or 3, wherein the support portion of the cathode is provided by a U-shaped metal strip, the bent portion of the U-shaped metal strip being fixed to the metal substrate and the filament being held between a pair of free end portions of the U-shaped metal strip.

8. The assembly according to claim 1 or 3, wherein the support portion of the cathode is provided by a U-shaped metal strip, a pair of free end portions of the U-shaped metal strip being fixed to the metal substrate, and the filament being held at the bent portion of the U-shaped metal strip.

9. The assembly according to claim 1 or 3, wherein the support portion of the cathode is provided by a metal strip L-shaped at one end portion and U-shaped at the other end portion, the L-shaped portion being fixed to the metal substrate and the U-shaped portion serving to hold the filament.

10. The assembly according to claim 1 or 3, wherein the support portion of the cathode is provided by a metal strip L-shaped at one end portion and partly cut in the central portion, the cut portion being folded toward the other end of the metal strip so as to form a U-shaped portion for holding the filament, and the L-shaped portion being fixed to the metal substrate.

11. The assembly according to claim 1 or 3, wherein the support portion of the cathode is provided by a pair of metal strips each L-shaped at one end portion, the filament being held between the other end portions of the metal strips and the L-shaped portions of the metal strips being fixed to the metal substrate.

12. The assembly according to claim 1 or 3, wherein the support portion of the cathode is provided by a metal strip integral with the metal substrate, the metal strip being folded at the periphery of the metal substrate toward the center of the metal substrate, then, at right angles at the central portion of the metal substrate, and into U-shaped at the tip portion thereof for holding the filament at the U-shaped portion.

* * * * *